United States Patent [19]

Rulseh

[11] 4,311,886

[45] Jan. 19, 1982

[54] TIMING APPARATUS FOR LAMPS AND APPLIANCES

[75] Inventor: Roger D. Rulseh, New Holstein, Wis.

[73] Assignee: AMF Incorporated, White Plains, N.Y.

[21] Appl. No.: 141,444

[22] Filed: Apr. 18, 1980

[51] Int. Cl.[3] ..... H01H 7/00

[52] U.S. Cl. ..... 200/38 R; 200/38 B; 200/39 R; 200/38 BA

[58] Field of Search ..... 200/38 A, 38 DA, 38 DB, 200/38 DC, 38 R, 38 F, 38 FA, 38 FB, 38 B, 38 BA, 38 C, 38 CA, 38 D, 38 E, 39 R, 39 A, 40, 41; 307/141, 141.4, 141.8; 340/309, 309.1

[56] References Cited

U.S. PATENT DOCUMENTS

| | | | |
|---|---|---|---|
| 2,816,184 | 12/1957 | Manning et al. | 200/38 DA |
| 3,925,629 | 12/1975 | Albinget | 200/38 DA |
| 4,038,877 | 8/1977 | Kloenne et al. | 200/38 F |

*Primary Examiner*—J. V. Truhe
*Assistant Examiner*—Morris Ginsburg
*Attorney, Agent, or Firm*—George W. Price; Lawrence Hager

[57] ABSTRACT

Timing apparatus for controlling the ON-OFF operation of a lamp or appliance. The timing apparatus is plugged into an electric wall receptacle to energize an internal synchronous motor that turns a time dial with setting pins thereon. The pins control the opening and closing of internal switch means for the lamp or appliance. The apparatus is relatively small, and is simple to manufacture, assemble and service.

15 Claims, 16 Drawing Figures

FIG. 7
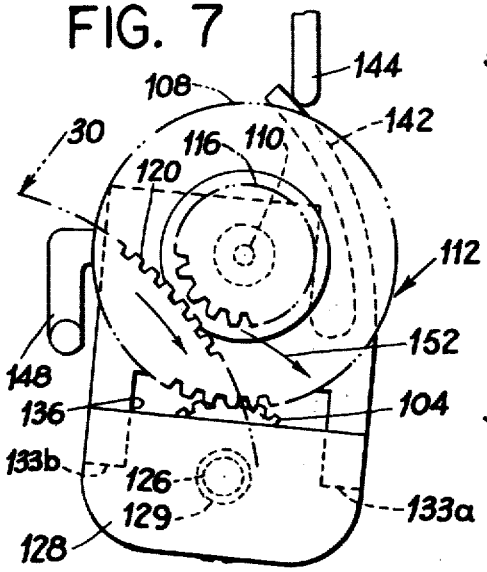
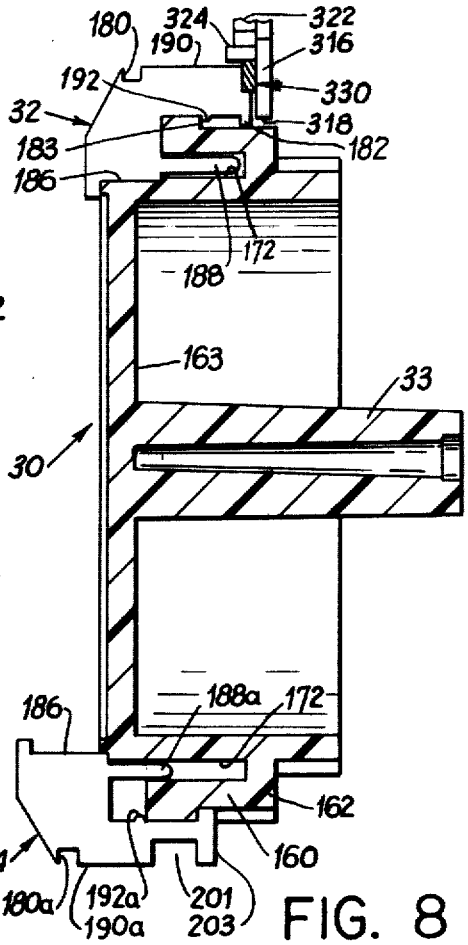
FIG. 8
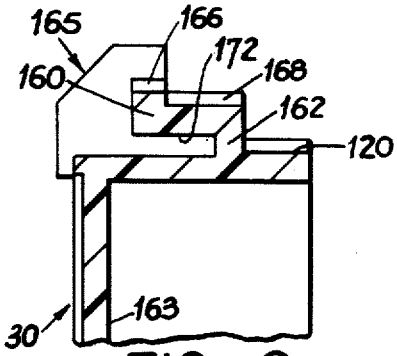
FIG. 9
FIG. 10
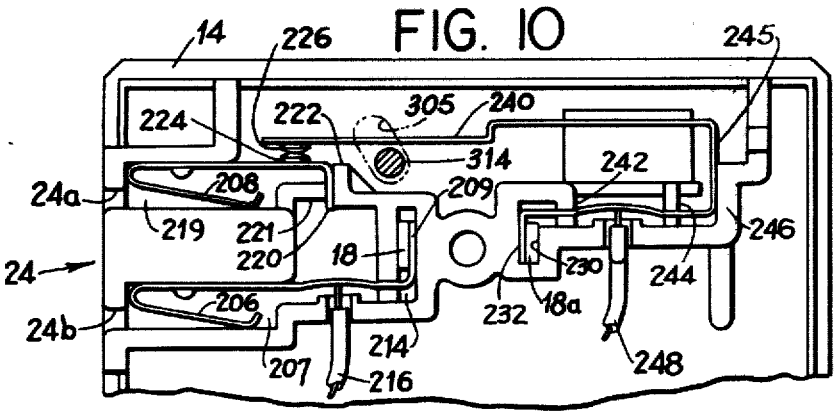

TIMING APPARATUS FOR LAMPS AND APPLIANCES

RELATED APPLICATION

A concurrently filed application entitled Actuating Means for Switch Operation in Timing Apparatus, by Ser. No. 140,357, discloses timing apparatus of the same type disclosed and claimed in this application.

This invention relates to electrical timing and switching apparatus for controlling the ON-OFF operation of household lamps and appliances. The apparatus plugs into an electrical receptacle commonly provided in the wall of a residence or office. The apparatus includes in its molded plastic case a female receptacle into which the plug of a lamp or electrical appliance cord is inserted. Time operated switching means within the case of the apparatus controls the connection of the female receptacle, and thus the lamp or appliance, to the source of electrical power that energizes the wall receptacle.

The apparatus of this invention provides accurate timing, is dependable and long lasting in operation, provides selectable modes of operation, is relatively small in size, and is easily assembled during manufacture and repair.

BRIEF DESCRIPTION OF DRAWINGS

FIG. 7 is a view similar to FIG. 5 that is used in explaining the operation of the apparatus of FIG. 5;

FIGS. 8 and 9 are full and partial sectional views of the time setting dial, with and without the setting pins that are shown on the front of the apparatus illustrated in FIG. 1;

FIG. 10 is a plan view showing only the internal portion of the apparatus that contains the electrical switching and electrical receptacle portions of the apparatus;

DETAILED DESCRIPTION OF THE DRAWINGS

Figure 1:
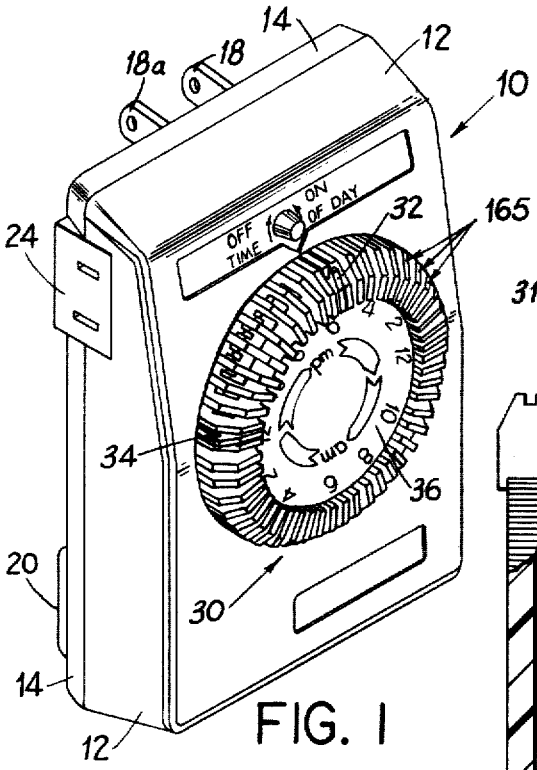
FIG. 1 is a perspective view of the timing and switching apparatus of this invention.
Figure 3:
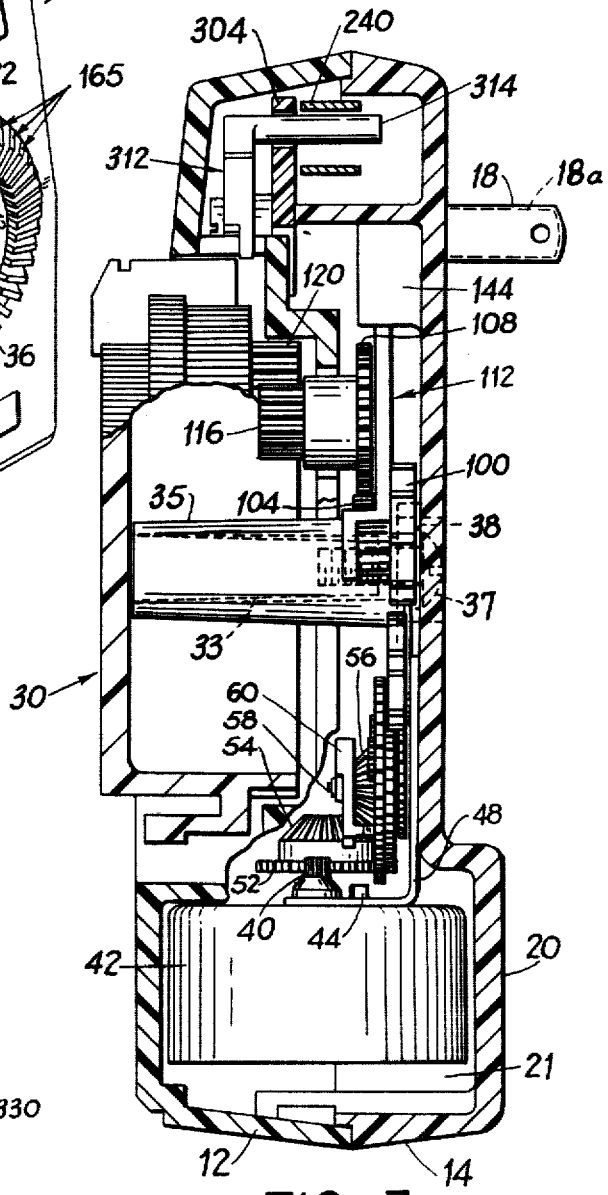
FIG. 3 is a side sectional view taken at section 3—3 of FIG. 2.
Figure 2:
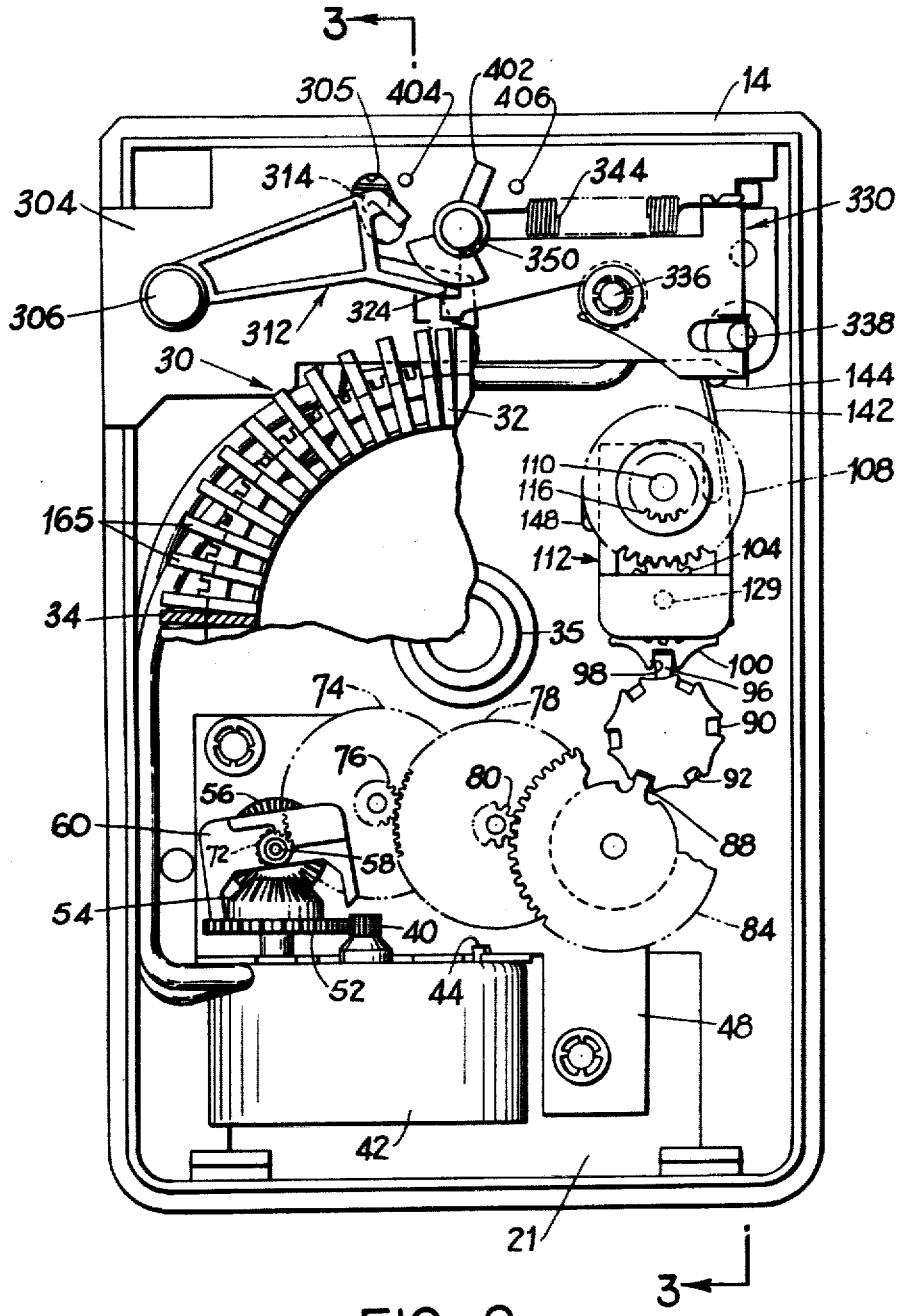
FIG. 2 is a plan view of the apparatus with the top cover of the case removed and with the time setting dial only partially shown in order to better illustrate the internal mechanism of the apparatus.

Referring to FIGS. 1–3, the lamp and appliance timing apparatus of this invention is comprised of a molded plastic case 10 formed of front and back case halves 12 and 14. As seen in FIG. 3, electrical connector prongs 18,18*a* extend through the back case half 14. Prongs 18,18*a* are insertable directly into an electrical power receptable in a wall of a home or office, for example. An outwardly extending portion 20 at the bottom region of back case half 14 contacts the surface of the wall to maintain the case in substantially a vertical attitude and parallel to the wall surface. This outwardly extending portion 20 helps maintain prongs 18 firmly in the wall receptacle by substantially eliminating a counterclockwise force that would tend to pull prongs 18 out of the receptacle if the timer case were cocked from the vertical, as it would be in the absence of outwardly extending portion 20.

A female receptacle 24, FIG. 1, is located at the upper left side of the timer case. The electrical plug of the lamp or appliance whose operation is to be controlled will be plugged into receptacle 24.

A rotatable time setting dial 30 is located in a recess molded in front cover half 12. As best illustrated in FIG. 3, time setting dial 30 is comprised of an integrally molded axial shaft 33 that is rotatably supported in a hollow shaft 35 which in turn is an integrally molded part of back case half 14. Removable fastening means such as a screw and washer 37, 38 are received in back case half 14. Screw 37 is threaded into the end of axial shaft 33 of dial 30 and is fixedly held therein. The washer is larger in diameter than the hollow portion of shaft 35 and allows screw 37 to rotate thereon. Consequently, dial 30 is easily assembled to the remainder of the apparatus and is easily disassembled to permit access to the interior of case 10.

As will be explained in more detail below, dial 30 is comprised of ON and OFF setting pins 32 and 34, respectively, that are circumferentially disposed about a centrally positioned time-of-day indicator 36 that has at least some of the numerals of a 24 hour day thereon. In accordance with the illustrated embodiment of the invention, there may be from one up to 24 ON-OFF timing operations of the switching means in a 24 hour day.

Time setting dial 30 is coupled through a speed reducing gear train, FIGS. 2 and 3, to the output pinion 40 of a synchronous electrical motor 42. Motor 42 is secured by punched out tabs 44, or other suitable means, to an angle bracket 48 that is secured by lock washers to studs (not shown) that are molded on the wall of back case half 14. Motor 42 is positioned in an enlarged cavity 21 that is formed in back case 14 by outwardly extending back wall portion 20 of back case half 14. Motor 42 occupies substantially the entire interior space of cavity 21. It is seen that motor 42 is positioned so that the axis of rotation of its output pinion 40 is vertical and normal to the axis of rotation of time dial 30. This orientation is different from that of prior art apparatus of this type wherein the axis of the motor output pinion is horizontal.

Some type of wall standoff means commonly is employed on the back case half of plug in timer apparatus of this general type. In the apparatus of this invention, the outwardly extending portion 20 that forms cavity 21 serves as a wall standoff as well as permitting motor 42 to be mounted for vertical rotation, thus allowing case 10 to be thinner.

Figure 4:
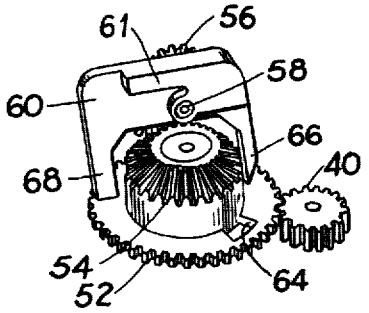
FIG. 4 is a perspective view showing only the directional stop mechanism that permits the synchronous motor to continuously rotate in only one direction.

Output pinion 40 of synchronous motor 42 is in engagement with driven gear 52, FIGS. 3 and 4, that rotates about an axial pin that is secured to angle bracket 48. Driven gear 52 is molded from a plastic material and is integral and coaxial with bevel gear 54. A second bevel gear 56 is in mesh with level gear 54 and rotates on axial pin 58 that is supported on the vertical portion of bracket 48.

A rigid directional stop member 60 having the general shape of an inverted letter U has its transverse or bite portion 61 mounted on axial pin 58. Directional stop member 60 frictionally engages bevel gear 56 with a predetermined amount of friction so as to rock clockwise when gear 56 turns clockwise, and rock counterclockwise when gear 56 turns counterclockwise. The initial direction of rotation of bevel gear 56 is determined by the initial direction of rotation of synchronous motor 42. As is known, synchronous motor 42 may start rotating in either direction when it is first energized. Directional stop member 60 functions to assure that motor pinion 40 will continuously turn only in the counterclockwise direction, looking down on the top of pinion 40. This is the desired direction for causing time dial 30 to rotate in the clockwise direction. Directional stop member 60 functions as follows.

In FIG. 4 an aperture 64 extends transversely through gear 52 at, or adjacent, the base of bevel gear 54. The right leg 66 of directional stop member 60 terminates in a pointed end that is adapted to freely fit within aperture 64 in gear 52. The left leg 68 of directional stop member 60 is shorter than the right leg and extends radially farther out from axial pin 58 than the right leg does. The bottom end of left leg 68 is blunt.

Should pinion 40 rotate in the undesired clockwise direction, gear 52 and bevel gear 54 will rotate counterclockwise, FIG. 4. Driven bevel gear 56 rotates clockwise. The frictional engagement of directional stop member 60 with bevel gear 56 causes stop member 60 to rock in a clockwise direction until the pointed end of right leg 66 strikes the top surface of rotating gear 52. Pinion gear 40 and bevel gear 56 continue to rotate in the now stationary stop member 60. When aperture 64 in rotating gear 52 comes into registration with the pointed end of leg 66, stop member 60 will rotate further in the clockwise direction as the pointed end of leg 66 falls in the aperture 64. Stationary leg 66 of the stop member 60 now will block further counterclockwise rotation of gear 52, i.e., clockwise rotation of pinion 40. On the other hand, when motor 42 rotates with pinion 40 rotating in the counterclockwise direction, gear 52 and bevel gear 54 rotate in the clockwise direction. Driven bevel gear 56 rotates in the counterclockwise direction and causes directional stop member 60 to rock counterclockwise. The blunt bottom end of left leg 68 of the stop member contacts the top surface of gear 52. This blunt end is radially beyond aperture 64. Consequently, end 68 merely slides on the top surface of gear 52 and motor 42 continues to rotate. Gear 52 and directional stop member 60 are molded from a plastic material that has a low coefficient of friction so that, together with the predetermined frictional engagement of stop member 60 bevel gear 56, motor 42 is not significantly loaded when left leg 68 of stop member 60 continuously slides on the top surface of gear 52.

Returning to FIGS. 2 and 3, pinion gear 72 is molded integrally with driven bevel gear 56 and drives flat gear 74 and its integrally molded pinion 76 in a clockwise direction, looking at FIG. 2. This motion is transmitted through gears 78 and 80 to rotate flat gear 84 in the clockwise direction. Gear 84 has molded integrally therewith a Geneva drive tooth 88 for driving a Geneva follower gear 90 that has six radial tooth receiving slots 92. Therefore, Geneva follower gear 90 makes one complete revolution every six revolutions of gear 84.

Geneva follower gear 90 has integrally molded therewith, on a different level, a second Geneva drive tooth 96 that successively engages the six radial slots 98 of a second Geneva follower gear 100. A pinion gear 104 is molded integrally with and at a lever above second Geneva gear 100.

Figure 5:
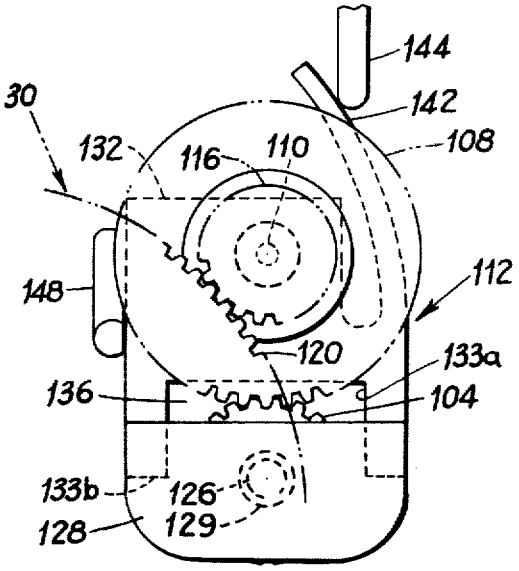
FIG. 5 illustrates in detail a portion of the gear train and the mechanism that allows the time dial on the front of the case to be rotated only in one direction.
Figure 6:
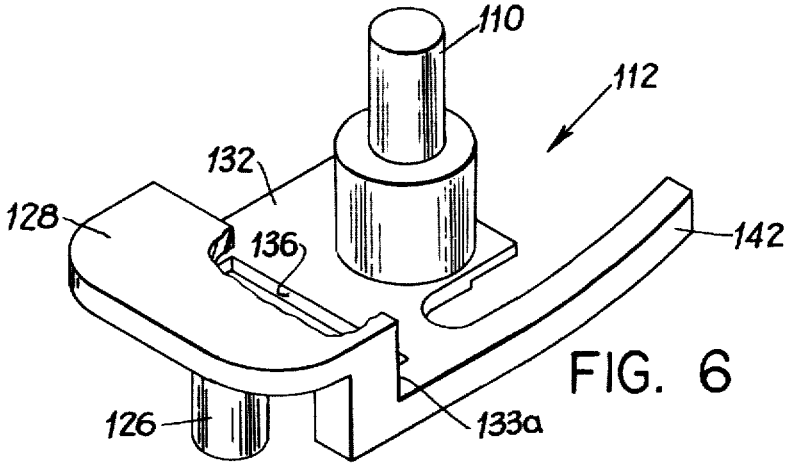
FIG. 6 is a perspective view of the frame member that is illustrated in plan view in FIG. 5.

Pinion gear 104 drives a flat gear 108 that is rotatably mounted on an axle pin 110 of a frame member 112, FIGS. 5 and 6. Frame 112 is part of a one-way directional rotation mechanism for time dial 30, as will be described below. Pinion gear 116 is molded integrally with, and is positioned above, flat gear 108. As shown in FIGS. 3 and 5, pinion 116 meshes with the teeth of gear 120 that is molded integrally with the body of time dial 30.

Before proceeding to describe how time dial 30 and the switch actuating mechanism cooperate to open and close the switch contacts that are located at the top of the case, it first will be explained how the above mentioned one-way directional rotation mechanism permits time dial 30 to be turned only in a clockwise direction by an operator who is setting the dial for the desired ON-OFF times.

Referring in particular to FIGS. 2, 5 and 6, frame member 112 is a unitary member of molded plastic and has an axial pivot pin 126 that extends to the rear from a front bottom plate 128. Bottom plate 128 extends outwardly from, and is parallel to, the main plate 132. Arms **133*a* and 133*b* join the two plates in an integral unit. A void space 136 exists between arms 133*a* and 133*b***.

Axial pin 110 is molded integrally with main plate 132 and extends forwardly therefrom. As seen in FIG. 5, flat gear 108 that is rotatably mounted on axial pin 110 meshes with pinion 104 in the void space 136. Geneva gear 100 and its integrally molded pinion 104 are rotatably mounted on back case half 14 by a hollow axial pin 129. Axial pivot pin 126 that extends to the rear from bottom plate 128 of frame 112 is received in hollow axial pin 129 so that the entire frame is rotatable about hollow pin 129, and consequently, is rotatable about pinion 104.

Frame 112 includes a leaf spring 142 on its upper right side, FIGS. 2 and 5. Frame 112 is molded of a plastic material that provides an inherent resiliency for leaf spring 142. A spring stop member 144 extends upwardly from the wall of back case half 14 and retains leaf spring 142 in the position illustrated in FIGS. 2 and 5. A frame stop member 148 also extends upwardly from the wall of back case half 14. Frame 112 normally is spring biased by leaf spring 142 into contact with frame stop member 148. Because of frame stop member 148, frame 112 is prevented from rotating counterclockwise about hollow axial pin 129. Frame member 112 may rotate clockwise through a small angle, however, when leaf spring 142 bends in response to a clockwise force being applied to frame 112.

The one-way operation of time dial 30 is best understood by referring to FIGS. 5 and 7. First, it should be understood that rotary force applied by gear teeth 120 against the teeth of pinion gear 116 will not cause gear 116 to rotate due to friction and the gear ratio in the gear train. When time dial 30 is manually rotated in the clockwise direction, as it will be during setting, for example, the engagement of gear 120 on time dial 30 with pinion 116 causes a force to be transmitted to pinion 116 that acts to the right, see arrow 152, FIG. 7. This force is transmitted through pin 110 to frame 112. Leaf spring 142 bends or bows in response to this force and allows frame 112 to pivot about its axial pivot pin 126 that is pivotally supported in hollow axial pin 129. When frame 112 has pivoted a sufficient distance, the teeth of gear 120 on time dial 30 will slide past the teeth of non-rotating pinion 116, thus allowing time dial 30 to rotate. In this manner, time dial 30 may be rotated in the clockwise direction to any desired time setting.

On the other hand, if it is attempted to rotate time dial 30 in the counterclockwise direction, the engagement of the teeth of gear 120 with the teeth of pinion 116 transmits a force to pinion 116 which tends to pivot frame 112 in a conterclockwise direction. This is evident from FIG. 5 wherein it is seen that the engagement between gear 120 and pinion 116 is to the left of a vertical line through the pivot axis (axial pin 126) of frame 112. However, fixed frame stop 148 is against the left side of frame 112 and will not allow it to pivot. Because pinion 116 will not rotate, gear 120 and pinion 116 remain engaged and time dial 30 is prevented from rotating in the counterclockwise direction. Of course, this explanation contemplates only reasonable force being applied to time dial 30 and does not hold if excessive and abusive force is applied.

Setting pins 32 and 34 are slidingly attached to the periphery of time dial 30 in the manner illustrated in FIGS. 8 and 9. A peripheral rim 160 extends completely around setting dial 30 and is attached to the main body thereof by means of a web portion 162. Desirably, the time dial assembly that includes rim 160, web 162 and the main body portion 163 is molded as an integral unit from a suitable plastic material.

As seen in FIGS. 1 and 9, 48 fin-like separators or partitions 165 are equiangularly spaced each 7.5° around the periphery of dial 30. Between adjacent separators 165 are pin setting positions comprised of sets of radially aligned grooves. In the illustrated embodiment there are 48 setting positions so that there may be up to 24 ON settings and 24 OFF settings in one 24 hour period, i.e., one revolution of time dial 30. In FIG. 9, a setting position is comprised of front groove 166 and back groove 168 on the outer edge of rim 160. It is seen that groove 166 is radially farther out than groove 168. The integral gear 120 that causes dial 30 to rotate is shown on the right side of FIG. 9.

A circumferential recess 172 extends between the inner edge of rim 160 and the outer edge of the main body portion 163 of dial 30. Recess 172 opens to the front of dial 30.

All ON setting pins 32 have the shape illustrated at the top of FIG. 8 and all OFF setting pins 34 have the shape illustrated at the bottom of FIG. 8. ON pin 32 is illustrated in its innermost position at which it causes contacts of the internal switching means to close. To pull ON setting pin 32 outwardly so that it will not affect the internal switch contacts, the user places a fingernail in the notch 180 and slides the pin to its outermost position. Pin 32 slides outwardly until tab 182 at the back of the pin contacts the vertical shoulder 183 on rim 160. As the pin 32 is pulled outwardly, an integrally molded detent 192 rides up and over groove 166 and falls over the front edge of that groove to releasably hold pin 32 in its outermost position.

An inwardly extending finger 188 on the bottom of ON pin 32 is received in a recess 172 that opens circumferentially to the front of time dial 30. Finger 188 helps maintain pin 32 in a set of grooves and allows it to slide smoothly therein.

OFF setting pin 34 is illustrated at the bottom of setting dial 30 in FIG. 8. Pin 34 also has a finger **188*a* that slides within circumferential recess 172 in the dial. The peripheral edge 190*a* has a notch 201 therein and an actuating tab 203 at its innermost end. As illustrated in FIG. 8, the detent 192*a* is in contact with the outer edge of rim 160 and the inner edge of actuating tab 203 is in contact with the inner edge of rim 160. OFF pin 34 is moved to its innermost position by pushing inwardly to cause detent 192*a* to move over the edge of rim 160 and slide over the back edge thereof. It is pulled outwardly by the operator placing a fingernail in notch 180*a*** and pulling out.

Both of the setting pins 32 and 34 have enough resiliency to permit the detenting action described above, and to allow the removal and insertion of the pins.

The electrical contacts and switch blades of the timing apparatus are shown in FIG. 10. On the left side of the drawing, apertures **24*a* and 24*b* of electrical receptacle 24 receive prongs of a male plug on the cord of a lamp or appliance whose operation is to be controlled. The inserted prongs make contact with the respective formed conductors 206 and 208 that are retained within compartments and passages that are molded in back cover half 14. Conductors 206 and 208 are formed from strips of resilient copper material, as is conventional in the art. The left end of conductor 206 has a reverse bend that is positioned within a molded recess 207 in back case half 14. The right end of conductor 206 has a right angle bend and its vertical leg 209 is securely wedged between the rear end of one of the male connector prongs 18 and the wall of a molded rectangular recess 214 in back case half 14. An insulated wire conductor 216 is electrically connected to an intermediate region of formed conductor 206. Wire 216 provides a continuous connection from male prong 18 to synchronous motor 42 at the bottom of case 10, see FIGS. 2 and 3**.

The left end of the other formed conductor 208 of receptacle 24 has a reverse bend that is positioned within a molded recess 219 in back case half 14. The right angle bend and the vertical leg 220 on the right end of conductor 208 is securely captured in a slot formed between upstanding molded partitions 221 and 222 on back case half 14. A contact button 224 is secured to conductor 208.

The second male prong **18*a* extends through the wall of back case half 14 and is securely wedged in a molded recess 230. The left end 232 of a movable contact blade 240 is wedged between prong 18*a* and the wall of molded recess 230. Contact blade 240 is securely held between two pairs of molded support ridges 242 and 244, and the vertical arm 245 on the right of FIG. 10 is supported against a molded partition 246. Contact blade 240 then makes an abrupt bend and is cantilevered to the left. A contact button 226 is secured to the left end of contact blade 240. Contact blade 240 is made of a resilient conductive material and is normally biased downwardly to the position illustrated in FIG. 10 to maintain contact buttons 224 and 226** in physical and electrical contact.

A second insulated wire conductor 248 is electrically connected to contact blade 240 at a region between support ridges 242 and 244. Wire 248 is the second conductor of synchronous motor 42, FIGS. 2 and 3. It is seen that when prongs 18 and 18*a* of the apparatus are plugged into a wall receptacle, wires 216 and 248 are continuously energized, irrespective of the position of movable contact blade 240. Consequently, wires 216 and 248 continuously energize synchronous motor 42 without regard to the switch means of the apparatus.

The mechanism for controlling the operation of contact blade 240 will be described in connection with FIGS. 2, 11–16. As seen in FIG. 2, a thin, rigid plastic cover member 304 covers and encloses the switching means illustrated in FIG. 10. Cover member 304 is secured to back case half 14 by suitable means such as a screw that is received in a molded post in the back case half 14. Cover member 304 has an aperture 305 extending therethrough to permit access to switch contact blade 240. An actuating lever 312 is pivotally mounted to the face of cover member 304 by means of a pivot pin 306 that is staked to the cover member. Actuating lever 312 includes an actuating finger 314 as an integrally molded part thereof, see FIG. 11. Finger 314 projects through aperature 305 in cover 304 and is positioned just below switch contact blade 240, FIG. 10. Finger 314 extends inwardly far enough to engage and raise contact blade 240 when actuating lever 312 is pivoted in the counterclockwise direction.

Actuating lever 312 also includes a pawl 316 whose free end 318 is positioned at the periphery of time dial 30. Pawl 316, and thus actuating lever 312, pivots up and down depending upon the positions of setting pins 32, 34 on time dial 30. Pawl 316 is approximately one-half the thickness of actuating lever 312.

Figure 11:
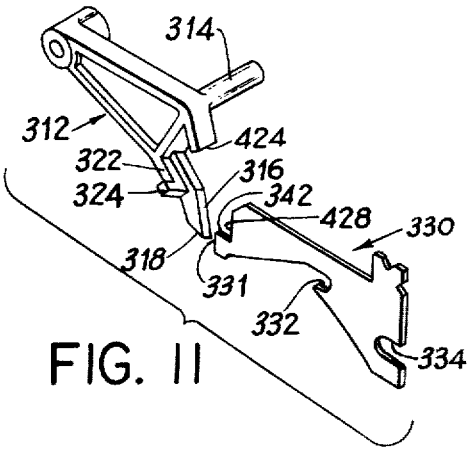
FIG. 11 comprises perspective views of the levers that function in response to the setting pins on the time dial to control the switching means.

As best seen in FIG. 11, a lever catch member 322 is located along the side of pawl 316 and has an outwardly extending stud 324 thereon. As will be explained below, catch member 322 is adapted to selectably engage a trip lever 330.

Figure 12:
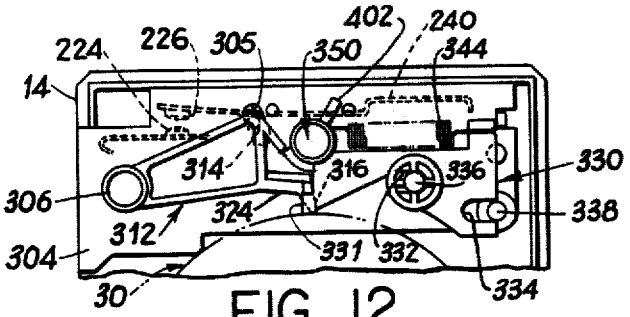
FIGS. 12–14 are various views of the levers showing how they operate to open and close the contacts of the internal switching means of the timing apparatus.

Trip lever 330 is a thin, rigid, flat member that has two laterally extending slots 332 and 334 within which are received the respective posts 336 and 338 that are molded integrally with contact cover member 304. Trip lever 330 is adapted to reciprocate laterally toward and away from actuating lever 312. A notch or step 342 on the left end of trip lever 330 is adapted to be positioned under catch member 322 and its stud 324 on actuating lever 312, see FIG. 14 which is a view looking up from below the levers 312 and 330. As illustrated in FIG. 12, when trip lever 330 is at its extreme left position and its notch 342 is engaged under catch member 322 of actuating member 312, the actuating finger 314 on the actuating lever engages and raises up the contact blade 240 so that contacts 224 and 226 are in their open positions.

A spring 344 has its right end attached to trip lever 330 and urges it toward actuating lever 312. The left end of spring 344 is attached to a post that is molded on cover member 304. An override or cancelling knob 350 is rotatably attached to that same post.

Setting pins 32 and 34 on time dial 30, FIG. 8, cooperate with actuating lever 312 and trip lever 330 to control the opening and closing of switch contacts 224 and 226, FIGS. 12–14, in the following manner. First, it is to be understood that helical spring 344 biases trip lever 330 to the left toward actuating lever 312. Contact blade 240 spring biases actuating lever 312 in the clockwise direction when contact blade 240 is in contact with actuating finger 314. Assume first that notch 342 at the left end of trip lever 330 is under catch member 322 and its stud 324 so that the levers are latched in the relative positions illustrated in FIG. 12. It is seen that actuating finger 314 has raised contact blade 240 and that contacts 224 and 226 are open. Also assume that both setting pins 32 and 34 are at their innermost positions. When setting pin 32 arrives at the location of the bottom left edge 331 of trip latch 330, the peripheral edge 190 of the pin engages only the edge 331 of trip lever 330, see FIG. 14. Pin 32 does not contact the actuating lever 312. As setting dial 30 and setting pin 32 continue to move in the clockwise direction, pin 32 pushes edge 331 of trip lever 330 beyond the outermost edge 324*a* of stud 324. Because contact blade 240 spring biases actuating lever 312 in a clockwise direction, lever 312 pivots off of notch 342 and assumes the position illustrated in FIG. 13 wherein the outermost ends of the two levers 312 and 330 are abutting each other. The clockwise rotation of actuating lever 312 is stopped when finger 314 reaches the bottom of aperture 305 in cover plate 304, FIG. 2. In this condition, contacts 224 and 226 are closed so that receptacle 24 on the side of back case 14 is energized. With the levers in this position, FIG. 13, the contacts remain closed and each time a setting pin 32 comes into actuating position, it merely engages edge 331 of trip lever 330 and pushes that lever to the right. Pin 32 does not contact actuating lever 312 so that the closed contacts 224 and 226 are not disturbed.

Assume next that setting pin 34 is in its innermost position and it is approaching the bottoms of levers 312 and 330 which are in the positions illustrated in FIG. 12. The path of actuating tab 203 on pin 34, FIGS. 8 and 14, is in registration with pawl 316 on actuating lever 312. Tab 203 engages the inclined surface of pawl 316 and raises the pawl and lever 312 as pin 34 continues to rotate in the clockwise direction. Actuating finger 314 engages and raises contact blade 240 and causes contacts 224 and 226 to separate. This deenergizes receptacle 24 on the side of case 10.

As tab 203 on setting pin 34 raises up pawl 316 and lever 312, the notch 201, FIG. 8, on the peripheral edge 190*a* of pin 34 is in registration with trip lever 330. Therefore, pin 34 will not contact trip lever 330 as actuating lever 312 is raised. When the bottom edge of stud 324 on latch member 322 raises up beyond the level of notch 342 on the left edge of trip lever 330, the spring bias provided by helical spring 344 causes trip lever 330 to slide to the left until the right end of latch member 322 and stud 324 are captured by, or latched onto, notch 342. Consequently, actuating lever is latched into its uppermost position in which actuating finger 314 holds up contact blade 240 so that contacts 224 and 226 are held open. The contacts will remain open until a setting pin 32 in its innermost position engages the left edge 331 of trip lever 330 to push that lever to the right far enough to allow actuating lever 312 to fall off the notch 342.

From the above discussion it is seen than an ON setting pin 32 in its innermost position actuates trip lever 330 and causes contacts 224 and 226 to close. When OFF setting pin 34 is in its innermost position it raises lever 312 which latches on trip lever 330 and holds contacts 224 and 226 separated from each other. When trip pins 32 and 34 are in the outermost positions they do not contact either one of the levers 312 or 330 and the condition of contacts 224 and 226 is not changed.

As previously mentioned, the illustrated embodiment of time dial 30 permits up to 24 ON-OFF operations in one 24 hour period. A number of desired operations up to 24 may be selected by proper settings of setting pins 32 and 34. Any number of ON-OFF operations a day may be selected by adding or taking away pairs of ON and OFF setting pins 32 and 34.

Manual override knob 350 is rotatably positioned between levers 312 and 330 and allows the operator to cancel or override the next scheduled ON or OFF automatic operation of the switching means. To do this, the operator manually sets the contacts in the ON or OFF condition so that the switching means already are in the condition to which they would be set by the next scheduled setting pin actuation of levers 312 and 330. For example, assume that it is 6:00 p.m. and that contacts 224 and 226 are open. Also assume that setting pins 32 and 34 are set on dial 30 so that they normally would actuate levers 312 and 330 to close the contacts at 7:00 p.m. and open them again at 11:00 p.m. By manually turning knob 350 in the counterclockwise direction at 6:00 p.m., catch lever 330 is slid to the right to release actuating lever 312 and allow it to fall, thereby allowing contact arm 240 to move downwardly and bring contact 226 into engagement with contact 224. Now when ON setting pin 32 arrives at the position to actuate lever 330, lever 330 already is at its extreme right position illustrated in FIG. 13 and the relative positions of the levers will not be changed. When the OFF lever 34 arrives at its actuating position at 11:00 p.m. it will function in its intended manner to raise lever 312 and permit trip lever 330 to slide in to hold lever 312 in the latched position illustrated in FIG. 12 wherein contacts 224 and 226 are open.

Figure 15:
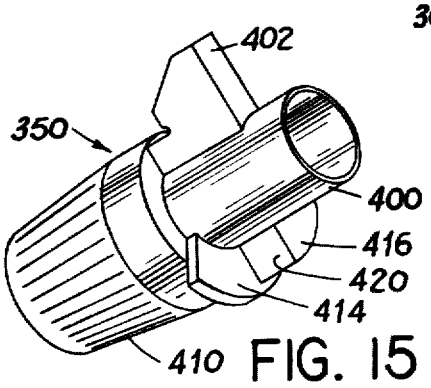
FIGS. 15 and 16 are views of an override or cancelling knob that may be used to cancel the ON or OFF switch operation that is scheduled to occur next in accordance with the settings of setting pins on the time dial.
Figure 16:
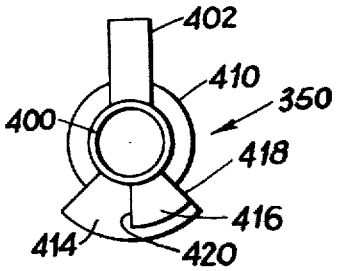

Override knob 350 and its operation will be described in detail by referring to FIGS. 11-16. In FIG. 15, the back end (right side) of the knob is comprised of a tubular shaft 400 that is rotatably mounted on a post that is molded on the front face of cover member 304. A vertical fin 402 extends upwardly from shaft 400. A pair of stop posts 404 and 406, FIG. 2, are molded on the front face of cover member 304 and limit the rotation of fin 402, and thus knob 350, to the angular segment between the two stop posts. In FIG. 15, a grooved barrel 410 is at the outermost end of knob 350 and is engaged by the user to turn the knob.

A pie shaped segment 414 is located at the base of barrel 410 and extends radially beyond the periphery of the base of barrel 410. A smaller pie shaped segment 416 extends rearwardly toward the surface of the first pie shaped segment 414. As clearly seen in FIG. 16, the two segments 414 and 416 have a common radially extending boundary 418. The other radial edge or boundary 420 of the second pie shaped segment 416 is about midway between the side boundaries of segment 414.

Figure 13:
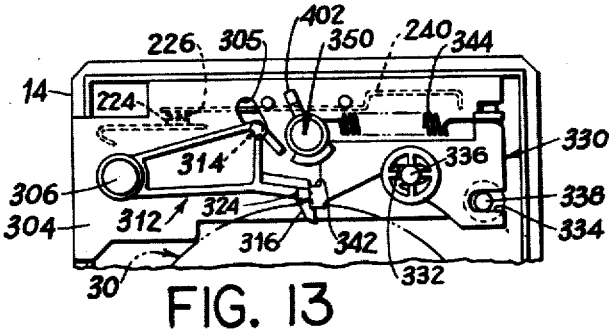
Figure 14:
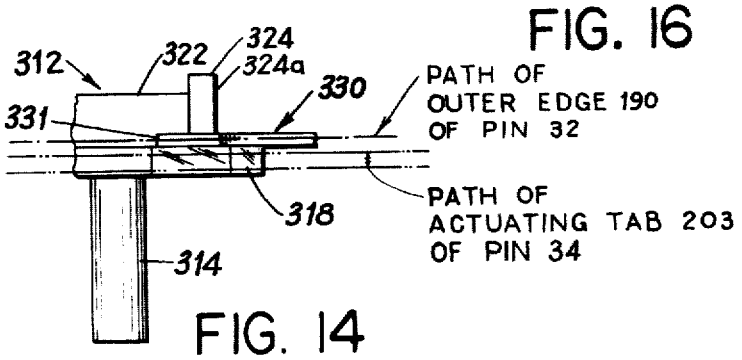

When the tubular shaft 400 of knob 350 is inserted over a post on cover 304 to the normal positions illustrated in FIGS. 12 and 13, the common boundary 418 of the pie shaped segments 414 and 416 is proximate the push finger 424 of actuator lever 312, FIG. 11. Radial boundary 420 of the second pie shaped segment 416 is adjacent the upper left corner 318 of trip lever 330. Consequently, when knob 350 is rotated in the clockwise direction, radial boundary 418 engages push finger 424 of actuating lever 312 and raises the lever up high enough for trip lever 330 to slide under catch member 322 and stud 324 on the actuating lever and hold it latched in its upper position, FIG. 12, in which contacts 224 and 226 are separated.

When knob 350 is rotated in the counterclockwise direction, radial boundary 420 engages only the upper left edge of trip lever 330 and pushes that lever to the right far enough to allow actuating lever 312 to fall off the notch 342 on the left end of trip lever 330. Actuating lever 312 then is urged by contact arm 240 to the position illustrated in FIG. 13 in which contacts 224 and 226 are closed. Looking at FIG. 16, the portion of the first pie shaped segment 414 that extends to the left of boundary 420 lies in front of the upper left edge of trip lever 330.

It is seen from the drawings that the timer is relatively easy to assemble, and is easy to take apart for servicing, if necessary. In assembling the apparatus, the gear train and motor 42 are mounted in back case half 14, and the electrical prongs and conductors illustrated in FIG. 10 are inserted and retained by friction fit in the positions illustrated. The thin, rigid, plastic switch cover 304, FIG. 2, is secured to the top portion of back case half 14 to enclose the electrical conductors that are illustrated in FIG. 10.

Actuating lever 312 is pivotally attached to cover 304 as by staking or riveting. If desired, the stake or rivet 306 may be in the form of an eccentric that may be rotated to move the pawl 316 of actuating lever 312 slightly to one side or the other, thereby providing an adjustment means to assure the proper engagement between actuating lever 312 and trip lever 330.

Trip lever 330 is inserted over posts 336 and 338 on cover 304 and helical spring 344 and override knob 350 are inserted, as illustrated.

Front case half 12 then is placed over back case half 14, FIG. 3, and a screw is screwed into post 35 that is molded on back case half 14. The molded axial shaft 35 that is molded on back case half 14 has a central hole portion for rotatably receiving axial shaft 33 therein. Screw and washer 37, 38 then are affixed as illustrated in FIG. 3 to hold time dial rotatably affixed to case 10. The case may be taken apart by removing screw 37 and taking time dial 30 away from the case 10.

In its broader aspects, this invention is not limited to the specific embodiment illustrated and described. Various changes and modifications may be made without departing from the inventive principles herein disclosed.

What is claimed is:

1. Timing apparatus for controlling the energization of an electrical plug receptacle into which the cord of a lamp or appliance, or the like, may be plugged, comprising a case comprised of first and second case portions that provide, at least partially, front and back walls of the case, an electrical plug receptacle within the case and adapted to receive prongs of an electrical plug of a lamp, appliance, or the like, electrical switch means within said case having at least one movable contact blade that may be selectively moved to open and close contacts of the switch means, means extending through said case for connecting said switch means to a source of electrical power, electrical conductor means coupling said switch means to said plug receptacle for energizing the receptacle when the switch means is closed and for deenergizing the plug receptacle when the switch means is open, a time dial mounted on said case for rotation about an axis that is substantially normal to said front and back walls, said second case portion having an outwardly extending back wall portion at or adjacent one end thereof that forms an enlarged cavity between said front and back walls of the case, a synchronous electrical motor mounted in said enlarged cavity, means for connecting said motor to said source of electrical power for energizing said motor, said motor having an output pinion whose axis of rotation is normal to the axis of rotation of the time dial, gear train means coupling said motor pinion to said time dial to rotate the time dial as a function of the motor pinion rotation;

said gear train means including a rotating flat gear, an aperture extending transversely through said rotating flat gear, an axial pin rotatably coupled to said gear train means at a location proximate said rotating flat gear and rotating about an axis normal to the axis of rotation of the rotating flat gear, a rigid stop member pivotally supported on said axial pin, said axial pin rotating the stop member when the pin rotates, said pin continuing to rotate when driven by the gear train means even though the stop member is prevented from further rotation, the stop member having a leg that extends toward and overhangs the flat gear, said leg being so shaped and radially positioned that it will fit within said transverse aperture in the flat gear when the stop member rocks in one direction on the axial pin and contacts the rotating flat gear, said leg withdrawing from the flat gear when the stop member rocks in the opposite direction, whereby said flat gear, and thus said motor pinion, may rotate in only one direction, said gear train means further including a circular gear associated with said dial, a second pinion gear engagable with the circular gear to rotate the dial through complete revolutions, a rigid frame member rotatably supporting said second pinion gear, means for pivotally supporting said frame member to permit the second pinion gear to pivot into and out of driving engagement with said circular gear, spring means for resiliently biasing said frame member to bring the second pinion gear into engagement with the circular gear and permitting the second pinion gear to pivot away from the circular gear against the bias of the spring means, fixed frame stop means engagable with said frame member for preventing the frame member from pivoting beyond the position that brings the second pinion gear into engagement with the circular gear but permitting the frame member to pivot in the opposite direction, a plurality of time setting means selectively positionable on said dial at locations corresponding to desired times of day, switch actuation means responsive to selectively positioned time setting means when desired time of day locations on the time dial move to an actuating position, switch actuation means comprising an actuating lever and a trip lever, said actuating lever being pivoted at one end to pivot about an axis that is parallel to the axis of rotation of said time dial, the other end of the actuating lever including a pawl that engages selectively positioned ones of the time setting means at said actuating position, said time setting means that engage the actuating lever operating to pivot the actuating lever away from the time dial, said actuating lever including a catch member adjacent said pawl, said trip lever being movable toward and away from the actuating lever and including means engagable with said catch member on the actuating lever to latch the actuating lever away from the time dial when so engaged, spring means for translating said trip lever into latching engagement with an actuating latch when said other end of the actuating lever has been pivoted a given distance away from the time dial, at least some of said time setting means being selectively positionable to engage only said trip lever at said actuating position to translate the trip lever away from the actuating lever, and to unlatch the free end of the actuating lever, and an actuation finger on the actuating lever for engaging said contact blade and opening said switch means only when the actuating lever is latched.

2. Timing apparatus for controlling the energization of an electrical plug receptacle into which the cord of a lamp or appliance, or the like, may be plugged, comprising a case comprised of front and back molded plastic case halves that provide, at least partially, front and back walls of the case, an electrical plug receptacle in said case adapted to receive prongs of an electrical plug of a lamp, appliance, or the like, electrical switch means within said case having at least one movable contact blade that may be selectively moved to open and close contacts of the switch means, means extending through said case for connecting said switch means to a source of electrical power, electrical conductor means connecting said switch means to said plug receptacle for energizing the receptacle when the switch means is closed and for deenergizing the plug receptacle when the switch means is open, a time dial mounted on said case for rotation about an axis that is substantially normal to said front and back walls, said back case half having an outwardly extending back wall portion at or adjacent one end thereof that forms an enlarged cavity beween said front and back walls of said case halves, a synchronous electrical motor mounted in said enlarged cavity, means for connecting said motor to said source of electrical power for energizing said motor, said motor having an output pinion whose axis of rotation is normal to the axis of rotation of the time dial, gear train means coupling said motor pinion to said time dial to rotate the time dial as function of the motor pinion rotation, said gear train means including a flat gear having an axis of rotation parallel to that of the motor pinion, said flat gear being driven by said pinion, a first bevel gear coaxial with and rotatable with said flat gear, a second bevel gear having an axis of rotation normal to that of the first bevel gear and being in driven engagement with the first bevel gear, said second bevel gear being supported on an axial pin that rotates with the second bevel gear, an aperture extending transversely through said flat gear, a rigid U-shaped stop member frictionally supported on said axial pin rotating the stop member when the pin rotates and continuing to rotate when the stop member is prevented from further rotation, the U-shaped stop member having legs that extend toward and overhang the flat gear, one of said legs being so shaped and radially positioned that it will fit within said transverse aperture in the flat gear when the U-shaped member rocks in one direction on the axial pin and contacts the flat gear, the other one of said legs being radially positioned to be out of registration with the aperture in the flat gear when the U-shaped member rocks in the opposite direction and contacts the flat gear, whereby said flat gear, and thus said motor pinion, may rotate in only one direction, said gear train means further including a circular gear associated with said dial, a second pinion gear engagable with circular gear to rotate the dial through complete revolutions, a rigid frame member rotatably supporting said second pinion gear, means for pivotally supporting said frame member to permit the second pinion gear to pivot into and out of driving engagement with said circular gear, spring means for resiliently biasing said frame member to bring the second pinion gear into engagement with the circular gear and permitting the second pinion gear to pivot away from the circular gear against the bias of the spring means, fixed frame stop means engaging said frame member for preventing the frame member from pivoting beyond the position that brings the second pinion gear into engagement with the circular gear but permitting the frame member to pivot in the opposite direction, a plurality of time setting means selectively positionable on said dial at locations corresponding to desired times of day, switch actuation means responsive to selectively positioned time setting means when desired time of day locations on the time dial move to an actuating position, said switch actuation means controlling said movable contact blade in a predetermined manner in response to said setting means on the time dial, said switch actuation means comprising an actuating lever and a trip lever, said actuating lever being pivoted at one end to pivot about an axis that is parallel to the axis of rotation of said time dial, the other end of the actuating lever including a pawl that engages selectively positioned ones of the time setting means at said actuating position, said time setting means that engage the actuating lever operating to pivot the actuating lever away from the time dial, said actuating lever including a catch member adjacent said pawl, said trip lever being slidable toward and away from the actuating lever and including a notch engagable with said catch member on the actuating lever to latch the actuating lever away from the time dial when so engaged, spring means for translating said trip lever into latching engagement with an actuating latch when said other end of the actuating lever has been pivoted a given distance away from the time dial, at least one of said time setting means being selectively positionable to engage only said trip lever at said actuating position to translate the trip lever away from the actuating lever and to unlatch the free end of the actuating lever, and an actuation finger on the actuating lever for engaging said contact blade and opening said switch means only when the actuating lever is latched.

3. The combination claimed in claims 1 or 2 wherein said time setting means includes at least first and second settings pins both of which are retained on the periphery of said time dial, both setting pins being selectably slidable to an inner position and to an outer position, the first setting pin having means that contacts only the pawl of the actuating lever when in its inner position and at said actuating position, the second setting pin having means for contacting only the trip lever when in its inner position and at said actuating position, neither of the setting pins actuating either lever when in its outer position on the time dial.

4. Timing apparatus for controlling the energization of an electrical plug receptacle into which the cord of a lamp or appliance, or the like, may be plugged, comprising a case having front and back walls, an electrical plug receptacle within the case and adapted to receive the prongs of an electrical plug of a lamp, appliance, or the like, electrical switch means within said case having at least one movable contact blade that may be selectively moved to open and close contacts of the switch means, means extending through said case for connecting said switch means to a source of electrical power, electrical conductor means connecting said switch means to said plug receptacle for energizing the receptacle when the switch means is closed and for deenergizing the plug receptacle when the switch means is open, a time dial mounted on said case for rotation about an axis that is substantially normal to said front and back walls, said case having an outwardly extending back wall portion at or adjacent one end thereof that forms an enlarged cavity between said front and back walls of said case, a synchronous electrical motor mounted in said enlarged cavity, means for connecting said motor to said source of electrical power for energizing said motor, gear train means coupling said motor to said time dial for rotating the time dial as a function of the motor rotation, a plurality of time setting means selectively positionable on said dial at locations corresponding to desired times of day, switch actuation means responsive to selectively positioned time setting means when desired time of day locations on the time dial move to an actuating position, said switch actuation means controlling said movable contact blade in a predetermined manner in response to said time setting means on the time dial.

5. The timing apparatus claimed in claim 4 wherein said means extending through said case for connecting the switch means to a source of electrical power comprises male connector prongs fixed relative to said case and extending normally through the back wall of the case for insertion into a female electrical wall receptacle, said outwardly extending back wall portion that forms an enlarged cavity for receiving the synchronous motor being so constructed and dimensioned that it may contact a wall portion adjacent said wall receptacle when the connector prongs are inserted therein to maintain the case in a substantially vertical attitude parallel to said wall portion.

6. The combination claimed in claims 4 or 5 wherein said motor is mounted in the enlarged cavity with its output axis of rotation normal to the axis of rotation of the time dial.

7. Timing apparatus for controlling the energization of an electrical plug receptacle into which the cord of a lamp or appliance, or the like, may be plugged, comprising a case comprised of front and back walls, an electrical plug receptacle within the case and adapted to receive prongs of an electrical plug of a lamp, appliance, or the like, electrical switch means within said case having at least one movable contact blade that may be selectively moved to open and close contacts of the switch means, means extending through said case for connecting said switch means to a source of electrical power, electrical conductor means connecting said switch means to said plug receptacle for energizing the receptacle when the switch means is closed and for deenergizing the plug receptacle when the switch means is open, a time dial mounted on said case for rotation relative to said case, a synchronous electrical motor mounted in said case, means for connecting said motor to said source of electrical power for energizing said motor, gear train means coupling an output pinion gear of said motor to said time dial to rotate the time dial as a function of the motor pinion gear rotation, said gear train means including a flat gear, an aperture extending transversely through said flat gear, an axial pin rotatably coupled to said gear train means at a location proximate said flat gear and rotating about an axis normal to the axis of rotation of the flat gear, a rigid stop member pivotally supported on said axial pin, said axial pin rotating the stop member when the pin rotates, said pin continuing to rotate when driven by the gear train means even through the stop member is prevented from further rotation, the stop member having a leg that extends toward and overhangs the flat gear, said leg being so shaped and radially positioned that it will fit within said transverse aperture in the flat gear when the stop member rocks in one direction on the axial pin and contacts the flat gear, said leg withdrawing from the flat gear when the stop member rocks in the opposite direction, whereby said flat gear, and thus said motor pinion gear, may rotate in only one direction, setting means selectively positionable on said dial at locations corresponding to desired times of day, switch actuation means responsive to selectively positioned setting means when desired time of day locations on the time dial move to an actuating position, said switch actuation means controlling said movable contact blade in a predetermined manner in response to said setting means on the time dial.

8. Timing apparatus for controlling the energization of an electrical plug receptacle into which the cord of a lamp or appliance, or the like, may be plugged, comprising a case comprised of front and back walls, an electrical plug receptacle within the case and adapted to receive prongs of an electrical plug of a lamp, appliance, or the like, electrical switch means within said case having at least one movable contact blade that may be selectively moved to open and close contacts of the switch means, means extending through said case for connecting said switch means to a source of electrical power, electrical conductor means connecting said switch means to said plug receptacle for energizing the receptacle when the switch means is closed and for deenergizing the plug receptacle when the switch means is open, a time dial mounted on said case for rotation relative to said case, a synchronous electrical motor mounted in said case, means for connecting said motor to said source of electrical power for energizing said motor, gear train means coupling an output pinion gear of said motor to said time dial to rotate the time dial as a function of the motor pinion rotation, said gear train means including a flat gear having an axis of rotation parallel to that of the motor pinion gear, said flat gear being driven by said pinion gear, a first bevel gear coaxial with and rotatable with said flat gear, a second bevel gear having an axis of rotation normal to that of the first bevel gear and being in driven engagement with the first bevel gear, said second bevel gear being supported on an axial pin that rotates with the second bevel gear, an aperture extending transversely through said flat gear, a rigid U-shaped stop member frictionally supported on said axial pin, said axial pin rotating the stop member in a corresponding direction when the pin rotates in either direction further rotation, the U-shaped stop member having legs that extend toward and overhang the flat gear, one of said legs being so shaped and radially positioned that it will fit within said transverse aperture in the flat gear when the U-shaped member rocks in one direction on the axial pin and contacts the flat gear, the other one of said legs being radially positioned to be out of registration with the aperture in the flat gear when the U-shaped member rocks in the opposite direction and contacts the flat gear, whereby said flat gear, and thus said motor pinion gear, may rotate in only one direction, setting means selectively positionable on said dial at locations corresponding to desired times of day, actuation means responsive to selectively positioned setting means when desired time of day locations on the time dial move to an actuating position, said actuation means controlling said movable contact blade in a predetermined manner in response to said setting means on the time dial.

9. Timing apparatus for controlling the energization of an electrical plug receptacle into which the cord of a lamp or appliance, or the like, may be plugged, comprising a case comprised of front and back walls, an electrical plug receptacle within the case and adapted to receive prongs of an electrical plug of a lamp, appliance, or the like, electrical switch means within said case having at least one movable contact blade that may be selectively moved to open and close contacts of the switch means, means extending through said case for connecting said switch means to a source of electrical power, electrical conductor means connecting said switch means to said plug receptacle for energizing the receptacle when the switch means is closed and for deenergizing the plug receptacle when the switch means is open, a time dial mounted on said case for rotation relative to said case, a synchronous electrical motor mounted in said case, means for connecting said motor to said source of electrical power for energizing said motor, gear train means coupling an output pinion gear of the motor to said time dial to rotate the time dial as a function of the motor pinion gear rotation, said gear train means including a flat gear having an axis of rotation parallel to that of the motor pinion gear, said flat gear being driven by said pinion gear, a first bevel gear coaxial with and rotatable with said flat gear, a second bevel gear having an axis of rotation normal to that of the first bevel gear and being in driven engagement with the first bevel gear, said second bevel gear being supported on an axial pin that rotates with the second bevel gear, an aperture extending transversely through said flat gear, a rigid U-shaped stop member frictionally supported on said axial pin, said axial pin rotating the stop member in a corresponding direction when the pin rotates in either direction and continuing to rotate when the stop member is prevented from further rotation, the U-shaped stop member having legs that extend toward and overhang the flat gear, one of said legs being so shaped and radially positioned that it will fit within said transverse aperture in the flat gear when the U-shaped member rocks in one direction on the axial pin and contacts the flat gear, the other one of said legs being radially positioned to be out of registration with the aperture in the flat gear when the U-shaped member rocks in the opposite direction and contacts the flat gear, whereby said flat gear, and thus said motor pinion gear, may rotate in only one direction, said gear train means further including a circular gear associated with said dial, a second pinion gear engagable with the circular gear to rotate the dial through complete revolutions, a rigid frame member rotatably supporting said second pinion gear, means for pivotally supporting said frame member to permit the second pinion gear to pivot into and out of driving engagement with said circular gear, spring means for resiliently biasing said frame member to bring the second pinion gear into engagement with the circular gear and permitting the second pinion gear to pivot away from the circular gear against the bias of the spring means, fixed frame stop means engagable with said frame member for preventing the frame member from pivoting beyond the position that brings the second pinion gear into engagement with the circular gear but permitting the frame member to pivot in the opposite direction, time setting means selectively positionable on said dial at locations corresponding to desired times of day, switch actuation means responsive to selectively positioned setting means when desired time of day locations on the time dial move to an actuating position, said switch actuation means controlling said movable contact blade in a predetermined manner in response to said setting means on the time dial.

10. Timing apparatus for controlling the energization of an electrical plug receptacle into which the cord of a lamp or appliance, or the like, may be plugged, comprising a case comprised of front and back walls, an electrical plug receptacle within the case and adapted to receive prongs of an electrical plug, electrical switch means within said case having at least one movable contact blade that may be selectively moved to open and close contacts of the switch means, means extending through said case for connecting said switch means to a source of electrical power, electrical conductor means connecting said switch means to said plug receptacle for energizing the receptacle when the switch means is closed and for deenergizing the plug receptacle when the switch means is open, a time dial mounted on said case for rotation relative to said case, a synchronous electrical motor mounted in said case, means for connecting said motor to said source of electrical power for energizing said motor, gear train means coupling an output pinion gear of the motor to said time dial to rotate the time dial as a function of the motor pinion gear rotation, said gear train means including a circular gear associated with said dial, a second pinion gear engagable with the circular gear to rotate the dial through complete revolutions, a rigid frame member rotatably supporting said second pinion gear, means for pivotally supporting said frame member to permit the second pinion gear to pivot into and out of driving engagement with said circular gear, spring means for resiliently biasing said frame member to bring the second pinion gear into engagement with the circular gear and permitting the second pinion gear to pivot away from the circular gear against the bias of the spring means, fixed frame stop means engagable with said frame member for preventing the frame member from pivoting beyond the position that brings the second pinion gear into engagement with the circular gear but permitting the frame member to pivot in the opposite direction, time setting means selectively positionable on said dial at locations corresponding to desired times of day, switch actuation means responsive to selectively positioned setting means when desired time of day locations on the time dial move to an actuating position, said switch actuation means controlling said movable contact blade in a predetermined manner in response to said setting means on the time dial.

11. The combination claimed in claim 10 wherein said time dial is a molded plastic part and said circular gear associated therewith is molded integrally with the time dial.

12. The combination claimed in claim 10 wherein said frame member is a molded plastic part having a leaf spring molded integrally therewith, a leaf spring stop member fixed relative to said case and positioned to cooperate with the leaf spring to urge said second pinion gear into driving engagement with the circular gear.

13. The combination claimed in claim 12 wherein said leaf spring urges said frame member against said fixed frame stop means, said frame being pivotally supported at a position to be pivoted away from said fixed frame stop means and the circular gear when the dial is turned in one direction but being pivoted against said fixed frame stop means by said leaf spring and by the force applied by the circular gear when the dial is turned in the opposite direction.

14. Timing apparatus for controlling the energization of an electrical plug receptacle into which the cord of a lamp or appliance or the like, may be plugged, comprising a case comprised of front and back walls, an electrical plug receptacle within the case and adapted to receive prongs of an electrical plug of a lamp, appliance, or the like, electrical switch means within said case having at least one movable contact blade that may be selectively moved to open and close contacts of the switch means, means extending through said case for connecting said switch means to a source of electrical power, electrical conductor means connecting said switch means to said plug receptacle for energizing the receptacle when the switch means is closed and for deenergizing the plug receptacle when the switch means is open, a time dial mounted on said case for rotation relative to said case, a synchronous electrical motor mounted in said case, means for connecting said motor to said source of electrical power for energizing said motor, gear train means coupling an output pinion of said motor to said time dial to rotate the time dial as a function of the motor pinion rotation, time setting means selectively positionable on said dial at locations corresponding to desired times of day, switch actuation means responsive to selectively positioned time setting means when desired time of day locations on the time dial move to an actuating position, said switch actuation means comprising an actuating lever and a trip lever, said actuating lever being pivoted at one end to pivot about an axis that is parallel to the axis of rotation of said time dial, the other end of the actuating lever including a pawl that engages said selectively positioned time setting means at said actuating position, said time setting means that engage the actuating lever operating to pivot the actuating lever away from the time dial, said actuating lever including a catch member adjacent said pawl, said trip lever including means engagable with said catch member on the actuating lever to latch the actuating lever away from the time dial when so engaged, spring means for translating said trip lever into latching engagement with an actuating latch when the other end of the actuating lever has been pivoted a given distance away from the time dial, at least some of said time setting means being selectively positionable to engage only said trip lever at said actuating position to translate the trip lever away from the actuating lever and to unlatch said other end of the actuating lever, and an actuation finger on the actuating lever for engaging said contact blade and opening said switch means only when the actuating lever is latched.

15. The combination claimed in claim 14 wherein said time setting means includes at least first and second setting pins both of which are retained on the periphery of the time dial, both setting pins being selectably slidable to an inner position and to an outer position, the first setting pin having means that contacts only the pawl of the actuating lever when in its inner position and at said actuating position, the second setting pin having means for contacting only the trip lever when in its inner position and at said actuating position, neither of the setting pins actuating either lever when in its outer position on the time dial.

* * * * *